US010770852B2

(12) United States Patent
Wang et al.

(10) Patent No.: US 10,770,852 B2
(45) Date of Patent: Sep. 8, 2020

(54) CIRCUIT INTERCONNECTING DEVICE FOR LIGHTING DETECTION

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventors: Jiali Wang, Beijing (CN); Jiangtao Zhang, Beijing (CN); Peng Wang, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 300 days.

(21) Appl. No.: 15/735,664

(22) PCT Filed: May 11, 2017

(86) PCT No.: PCT/CN2017/083964
§ 371 (c)(1),
(2) Date: Dec. 12, 2017

(87) PCT Pub. No.: WO2017/215379
PCT Pub. Date: Dec. 21, 2017

(65) Prior Publication Data

US 2020/0036146 A1 Jan. 30, 2020

(30) Foreign Application Priority Data

Jun. 15, 2016 (CN) ..... 2016 2 0591408 U

(51) Int. Cl.
*H01R 12/00* (2006.01)
*H01K 1/00* (2006.01)
(Continued)

(52) U.S. Cl.
CPC ..... *H01R 31/06* (2013.01); *H01R 29/00* (2013.01)

(58) Field of Classification Search
CPC ..... H01R 31/06; H01R 31/065; H01R 13/64; H05K 1/117
(Continued)

(56) References Cited

U.S. PATENT DOCUMENTS 5,130,893 A * 7/1992 Straate ..... H02G 3/00 361/728
5,442,170 A * 8/1995 Kreft ..... H01R 29/00 250/229
(Continued)

FOREIGN PATENT DOCUMENTS

AU 219833 7/1957
AU 2279895 A 11/1995
(Continued)

OTHER PUBLICATIONS

Supplementary European Search Report for European Application No. EP 95 91 6220 dated Jul. 1, 1997.
(Continued)

*Primary Examiner* — Abdullah A Riyami
*Assistant Examiner* — Thang H Nguyen
(74) *Attorney, Agent, or Firm* — Calfee, Halter & Griswold LLP

(57) ABSTRACT

A circuit interconnecting device includes a circuit connection board and a circuit board which is detachable. The circuit connection board includes an input terminal, an output terminal and an onboard slot member. The input terminal is coupled to the onboard slot member through a first circuit, and the output terminal is coupled to the onboard slot member through a second circuit; and the
(Continued)

circuit board is inserted into the onboard slot member to connect the first circuit and the second circuit.

19 Claims, 4 Drawing Sheets

(51) Int. Cl.

| | |
|---|---|
| ***H01R 25/00*** | (2006.01) |
| ***H01R 27/00*** | (2006.01) |
| ***H01R 31/00*** | (2006.01) |
| ***H01R 33/00*** | (2006.01) |
| ***H01R 31/06*** | (2006.01) |
| ***H01R 29/00*** | (2006.01) |

(58) Field of Classification Search
USPC ..... 439/60, 638, 924.1, 924.2
See application file for complete search history.

(56) References Cited

U.S. PATENT DOCUMENTS

| | | | | |
|---|---|---|---|---|
| 5,683,261 | A | 11/1997 | Ahles et al. | |
| 7,778,749 | B2 * | 8/2010 | McGee | H01R 31/065 701/33.2 |
| 8,008,940 | B2 * | 8/2011 | Takase | G01R 31/31905 324/762.01 |
| 8,480,433 | B2 * | 7/2013 | Huang | B60R 16/0232 439/34 |
| 2004/0185685 | A1 * | 9/2004 | Nishizawa | G06K 19/07743 439/66 |
| 2013/0237092 | A1 * | 9/2013 | Rubens | H01R 13/6581 439/607.23 |
| 2016/0226167 | A1 * | 8/2016 | Ito | H01R 12/88 |

FOREIGN PATENT DOCUMENTS

| | | | |
|---|---|---|---|
| AU | 2514095 | A | 12/1995 |
| CA | 2185913 | A1 | 10/1995 |
| CN | 101984599 | B | 9/2013 |
| CN | 204349152 | U | 5/2015 |
| CN | 205670612 | U | 11/2016 |
| EP | 0755504 | A1 | 1/1997 |
| EP | 0755504 | B1 | 6/2002 |
| WO | 95/28617 | | 10/1995 |
| WO | 95/32534 | | 11/1995 |

OTHER PUBLICATIONS

Search Report for International Application No. PCT/CN2017/083964 dated Aug. 15, 2017.

Written Opinion for International Application No. PCT/CN2017/083964 dated Aug. 15, 2017.

* cited by examiner

CIRCUIT INTERCONNECTING DEVICE FOR LIGHTING DETECTION

CROSS-REFERENCE TO RELATED APPLICATIONS

The present application is based on International Application No. PCT/CN2017/083964, filed on Mary 11, 2017, which is based upon and claims priority to Chinese Patent Application No. 201620591408.5, titled "circuit interconnecting device" filed on Jun. 15, 2016, the entire contents of which are incorporated herein by reference.

TECHNICAL FIELD

The present disclosure relates to the field of display product detection technology, and more particularly to a circuit interconnecting device.

BACKGROUND

In the display field of TFT-LCD (Thin Film Transistor Liquid Crystal Display), OLED (Organic Light-Emitting Diode) and so on, it is necessary to perform a lighting detection on the display production during manufacturing and before leaving factory. Specifically, a display driving signal is transmitted from a pattern generator to a display device through a circuit interconnecting device, and then a detection person may detect the display screen.

In the related art, when a product is performed detection, the process of replacing the circuit interconnecting board is complex, resulting in a longer waiting time for the replacement, which badly affecting the detection efficiency, and in turn the production rate of production line.

SUMMARY

An objective of the present disclosure is to provide a circuit interconnecting device.

An embodiment of the present disclosure provides a circuit interconnecting device, including a circuit connection board and a circuit board which is detachable, wherein: the circuit connection board includes an input terminal, an output terminal and an onboard slot member, the input terminal is coupled to the onboard slot member through a first circuit, and the output terminal is coupled to the onboard slot member through a second circuit; and the circuit board is inserted into the onboard slot member to connect the first circuit and the second circuit.

When a lighting detection is performed on a display production by using the circuit interconnecting device provided by the embodiment of the present disclosure, if the model of display product is changed, it is only necessary to pull the circuit board out from the onboard slot member and reinsert a circuit board with a matched pin definition into the onboard slot member. In comparison with the related art, the operation is simple and convenient, which greatly increases the efficiency of a lighting detection performed on a display production, and in turn increases the production rate.

In an embodiment, the onboard slot member is perpendicular to a board body of the circuit connection board, and a socket is upward, which may facilitate the pulling and inserting of the circuit board effortlessly.

In an embodiment, the input terminal of the circuit connection board is an input slot member, and the output terminal of the circuit connection board is an output slot member.

In an embodiment, a socket of the input slot member and a socket of the output slot member face away from the onboard slot member.

In an embodiment, the circuit board includes a first wiring for transmitting a non-power supply signal and a second wiring for transmitting a power supply signal, a distance from an end of the second wiring to an insertion end plane of the circuit board is larger than a distance from an end of the first wiring to the insertion end plane of the circuit board. Therefore, a data transmission circuit for signal is connected firstly before the circuit board is connected to a power supply, which may effectively prevent data from being disturbed, and may realize a hot plugging.

In an embodiment, the first circuit includes a plurality of wirings arranged in parallel, and the second circuit includes a plurality of wirings arranged in parallel. With such design, the interference between the adjacent wirings may be reduced, and the wiring layout may be optimized, so that the structure of the circuit connection board is more compact.

In an embodiment, a surface of the circuit board is provided with a plurality of first side wirings which are insulated from each other, another surface of the circuit board is provided with a plurality of second side wirings which are insulated from each other, and the plurality of second side wirings are connected to the plurality of first side wirings one by one. A slot wall of the onboard slot member has a plurality of first connection terminals which are connected to the first circuit and connected to the plurality of first side wirings correspondingly, and a plurality of second connection terminals which are connected to the second circuit and connected to the plurality of second side wirings correspondingly. With such design, the structure of the circuit board may be optimized, and the interference between the adjacent wirings may be reduced, so that the connection between the circuit board and the onboard slot member is more reliable, which is favorable to the expansion of the circuit board.

In an embodiment, the first side wiring and the second side wiring corresponding to each other are connected through a vial hole in the circuit board. With such scheme, the shapes and positions of the first and second side wirings may be designed flexibly, and the connection is reliable. Further, the manufacture of the circuit board is relatively simple, which obtains a low cost.

In an embodiment, the first side wiring and the second side wiring corresponding to each other are connected through a printed circuit disposed on the circuit board.

In an embodiment, the circuit interconnecting device further includes a jig body, an input circuit and an output circuit, wherein the circuit connection board is fixed on the jig body, the input circuit is connected to the input terminal of the circuit connection board, and the output circuit is connected to the output terminal of the circuit connection board.

DETAILED DESCRIPTION

The embodiments of the present disclosure provide a circuit interconnecting device to increase the efficiency of a lighting detection performed on a display production, and in turn to increase the production rate. In order to make the objective, technical solutions and advantages of the present disclosure more clear, the present disclosure will be described below with reference to the exemplary embodiments.

Figure 1:
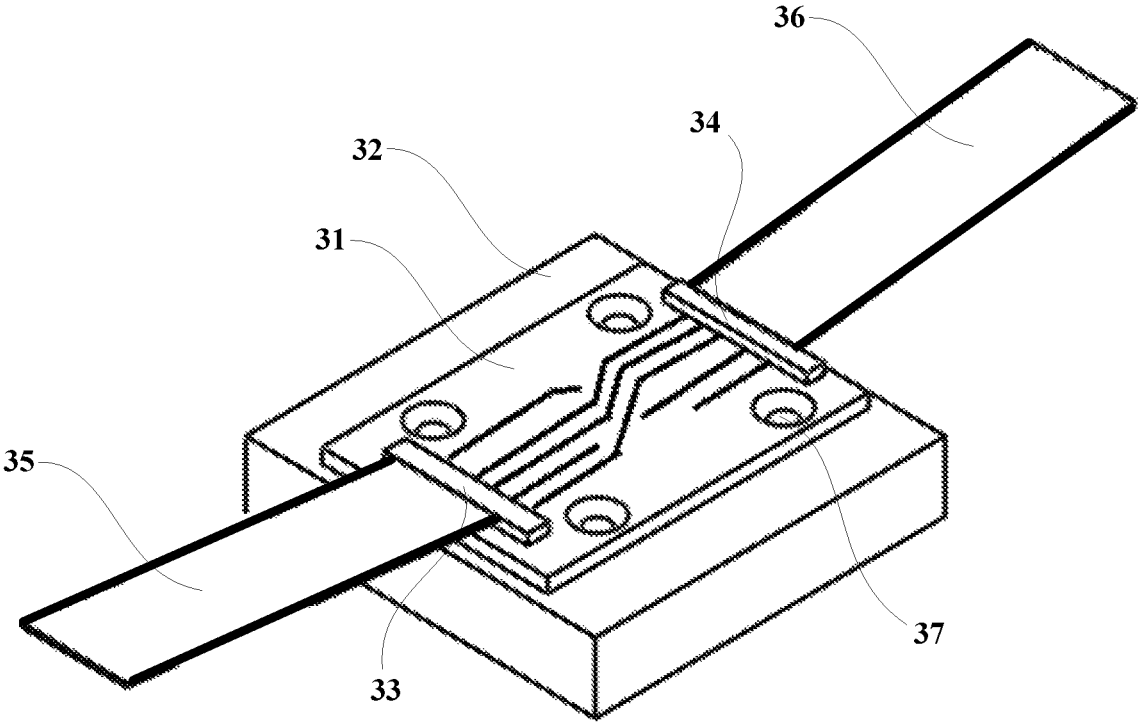
Prior Art Fig. 1
FIG. 1 is a schematic diagram of a circuit interconnecting device in the related art.

As shown in FIG. 1, in the related art, the circuit interconnecting board 31 is generally fixed to a jig body 32 through screws (provided at screw holes 37). The circuit interconnecting board 31 has an input slot member 33 and an output slot member 34. An input flexible circuit board 35, which may be connected to a pattern generator, is inserted into the input slot member 33. An output flexible circuit board 36, which may be connected to a display device, is inserted into the output slot member 34.

With the rapid development of the display technology, more and more display product models are put forward. Since display products of different models correspond to different pin definitions on the circuit interconnecting board, the circuit interconnecting board should be replaced frequently during the detection of the display production. Specifically, the input flexible circuit board 35 and the output flexible circuit board 36 are pulled out; the screws are unbolted to remove the circuit interconnecting board 31 from the jig body 32; a circuit interconnecting board with a matched pin definition is fixed to the jig body through the screws; and the input flexible circuit board 35 and the output flexible circuit board 36 are inserted into the input slot member 33 and the output slot member 34 respectively. For the circuit interconnecting device shown in FIG. 1, the replacement of the circuit interconnecting board is complicated during the production detection.

Figure 2:
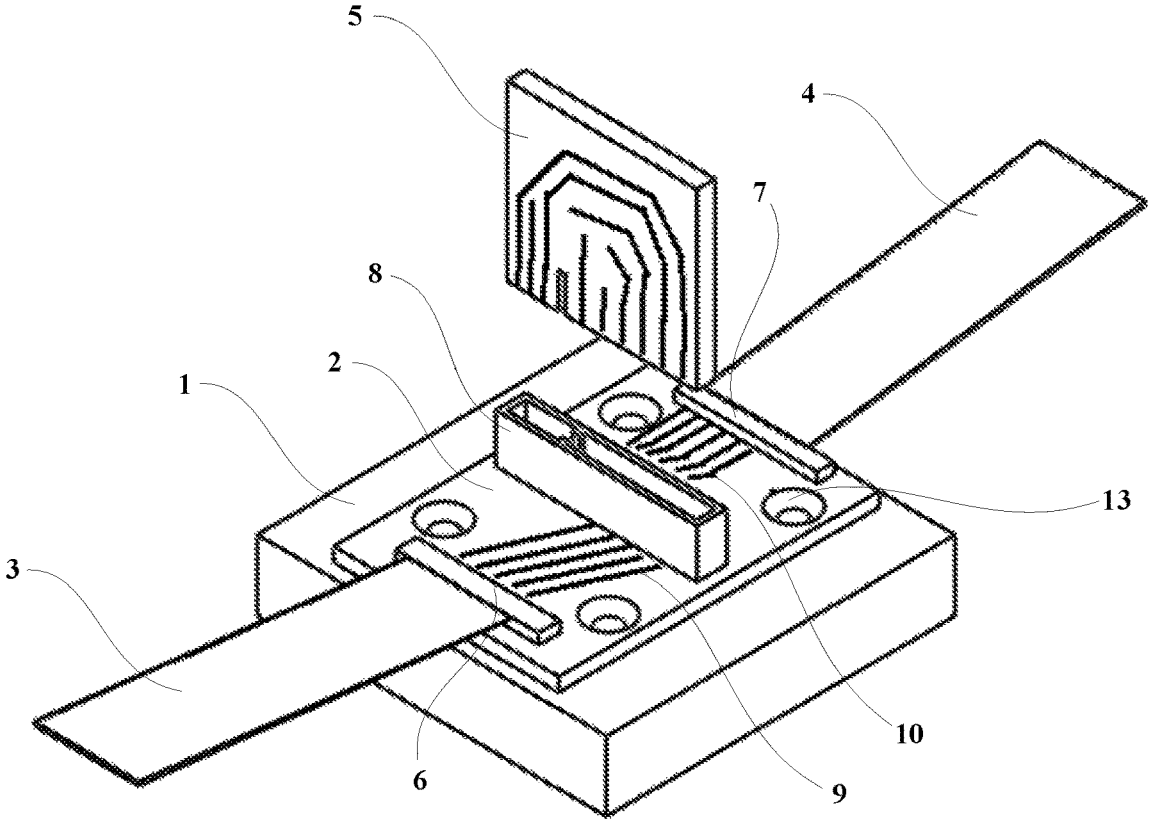
FIG. 2 is schematic diagram of a circuit interconnecting device according to an embodiment of the present disclosure.

As shown in FIG. 2, an embodiment of the present disclosure provides a circuit interconnecting device, including a circuit connection board 2 and a circuit board 5 which is detachable. The circuit connection board 2 includes an input terminal 6, an output terminal 7 and an onboard slot member 8, the input terminal 6 is coupled to the onboard slot member 8 through a first circuit 9, and the output terminal 7 is coupled to the onboard slot member 8 through a second circuit 10. The circuit board 5 is inserted into the onboard slot member 8 to make the first circuit 9 and the second circuit 10 electrically connected. The first circuit 9 and the second circuit 10 are conducting through the circuit board 5.

In the embodiment shown in FIG. 2, the circuit interconnecting device may further include a jig body 1, an input circuit 3 and an output circuit 4. The circuit connection board 2 is fixed on the jig body 1, the input circuit 3 is connected to the input terminal 6 of the circuit connection board 2, and the output circuit 4 is connected to the output terminal of the circuit connection board 2. The shape of the jig body 1 is not limited, and may be square or rectangular. The circuit connection board 2 is preferably fixed to the jig body 1 by a screw (provided at a screw hole 13 in the drawing and the screw is not shown in the drawing). If necessary, the circuit connection board 2 may be dismounted to be repaired and replaced. The types of the input circuit 3 and the output circuit 4 are not limited, and may be, for example, a printed circuit board or a flexible printed circuit board and so on.

The circuit interconnecting device provided by the embodiments of the present disclosure may be applied to the lighting detection of display products of various types including but not limited to a TFT-LCD display assembly and an OLED display assembly. During detection, it is necessary to use a circuit board that matching the pin definition of the display product.

When a lighting detection is performed on a display production by using the circuit interconnecting device provided by the above embodiment, if the model of display product is changed, it is only necessary to pull the circuit board out from the onboard slot member and reinsert a circuit board with a matched pin definition into the onboard slot member. In comparison with the related art, the operation is simple and convenient, which greatly increases the efficiency of a lighting detection performed on a display production, and in turn increases the production rate.

The disposing position of the onboard slot member 8 is not limited, and a socket thereof may be directed upwardly, toward a horizontal direction or toward other directions. Still referring to FIG. 2, in a preferable embodiment, the onboard slot member 8 is perpendicular to the board body of the circuit connection board 2, and the socket is upward, which may facilitate the pulling and inserting of the circuit board 5 effortlessly.

In the embodiment as shown in FIG. 2, the input terminal 6 of the circuit connection board 2 is an input slot member, and the output terminal 7 of the circuit connection board 7 is an output slot member. The input and output circuits 3 and 4 are inserted into the input and output slot members respectively, so that the operation of the pulling or inserting of the input and output circuits 3 and 4 are convenient, and the input and output circuits 3 and 4 are in protection.

In the above embodiment, sockets of the input slot member and the output slot member face away from the onboard slot member 8. In addition, the input slot member and the output slot member may be disposed at a same side with the sockets being directed towards a same direction. The disposing positions of the input slot member, the output slot member and the onboard slot member 8 are related to the layout of the first and second circuits 9 and 10 on the circuit connection board 2, which need to be designed according to practical situations.

Figure 3:
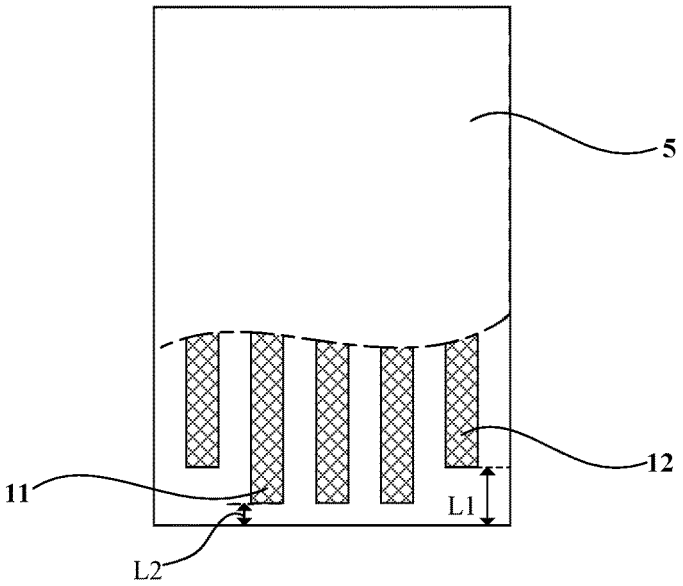
FIG. 3 is schematic diagram of a circuit board according to an embodiment of the present disclosure.

As shown in FIG. 3, in a preferable embodiment of the present disclosure, the circuit board 5 includes a first wiring 11 for transmitting a non-power supply signal and a second wiring 12 for transmitting a power supply signal. A distance L1 from an end of the second wiring 12 to an insertion end plane of the circuit board 5 is larger than a distance L2 from an end of the first wiring 11 to the insertion end plane of the circuit board 5. Therefore, a data transmission circuit for signal may be connected firstly before the circuit board 5 is connected to a power supply, which may effectively prevent data from being disturbed, and may realize a hot plugging.

Figure 4:
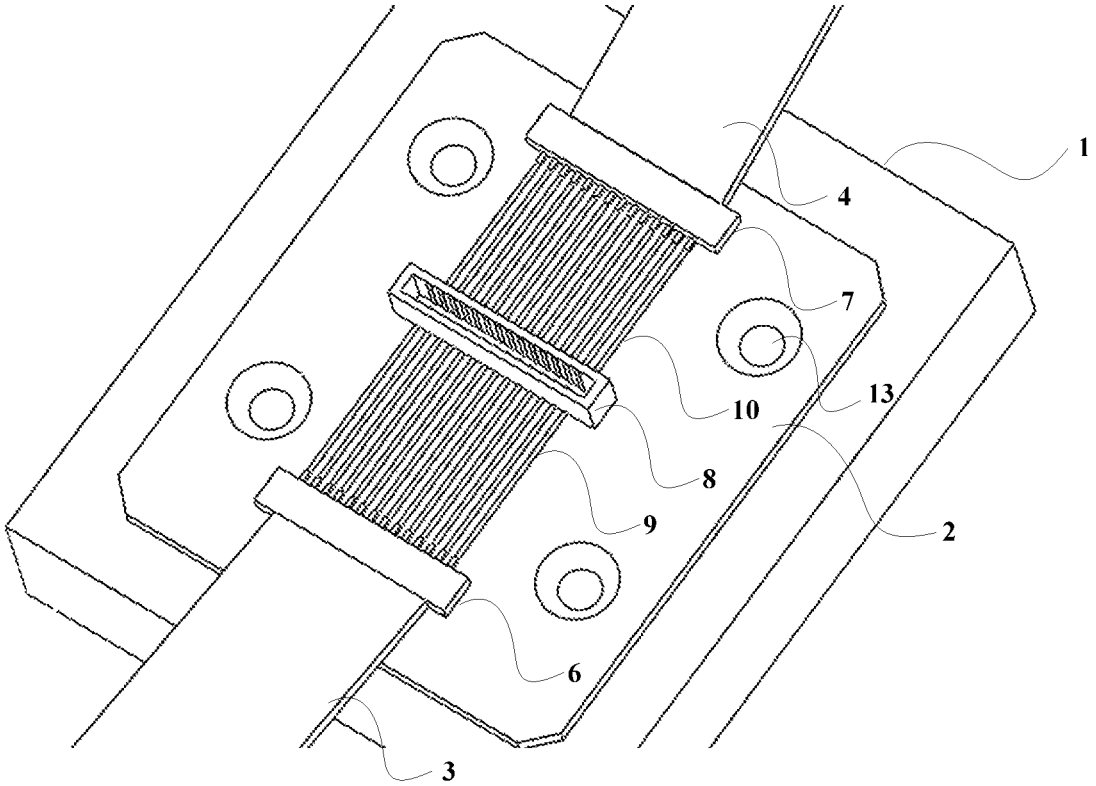
FIG. 4 is schematic diagram of a circuit connection board according to an embodiment of the present disclosure.

As shown in FIG. 4, in a preferable embodiment, the first circuit 9 includes a plurality of wirings arranged in parallel, and the second circuit 10 includes a plurality of wirings arranged in parallel. With such design, the interference between the adjacent wirings may be reduced, and the wiring layout may be optimized, so that the structure of the circuit connection board 2 is more compact.

Figure 5:
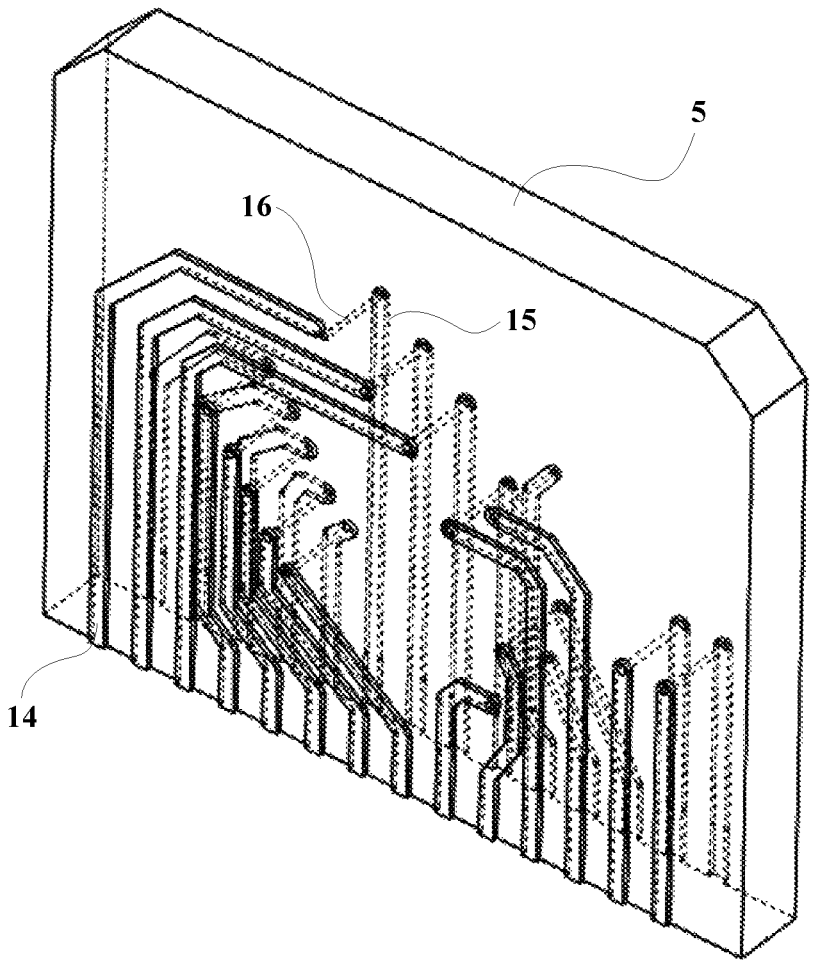
FIG. 5 is schematic diagram of a circuit board according to another embodiment of the present disclosure.

As shown in FIGS. 4 and 5, in a preferable embodiment, a surface of the circuit board 5 is provided with a plurality of first side wirings 14 which are insulated from each other, another surface of the circuit board 5 is provided with a plurality of second side wirings 15 which are insulated from each other, and the plurality of second side wirings 15 are connected to the plurality of first side wirings 14 one by one. A slot wall of the onboard slot member 8 has a plurality of first connection terminals (which are not shown with a reference sign in the drawing) which are connected to the first circuit 9 and connected to the plurality of first side wirings 14 correspondingly, and a plurality of second connection terminals (which are not shown with a reference sign in the drawing) which are connected to the second circuit 10 and connected to the plurality of second side wirings 15 correspondingly.

With such design, the structure of the circuit board 5 may be optimized, and the interference between the adjacent wirings may be reduced, so that the connection between the circuit board 5 and the onboard slot member 8 is more reliable, which is favorable to the expansion of the circuit board.

The connection structure of the first side wiring 14 and the second side wiring 15 corresponding to each other is not limited. For example, in an embodiment, the first side wiring and the second side wiring corresponding to each other are connected through a printed circuit disposed on a board body of the circuit board.

Still referring to FIG. 5, in an embodiment, the first side wiring 14 and the second side wiring 15 corresponding to each other are connected through a vial hole 16 in the circuit board 5. With such scheme, the shapes and positions of the first and second side wirings 14 and 15 may be designed flexibly (the shapes of the first and second side wirings 14 and 15 may be the same or may be different, and the pin sequences of the first and second side wirings 14 and 15 may be the same or different), and the connection is reliable. Further, the manufacture of the circuit board 5 is relatively simple, which obtains a low cost.

Based on the above, when a lighting detection is performed on a display production by using the circuit interconnecting device provided by the above embodiments, the efficiency of a lighting detection performed on a display production may be increased, and the production rate may be increased, which is favorable to extending the service life of the input circuit, the output circuit and the circuit interconnecting device.

It will be apparent to those skilled in the art that various changes and modifications may be made to the present disclosure without departing from the spirit and scope of the present disclosure. In this way, if the modifications and variations of the present disclosure are within the scope of the claims of the present disclosure and the equivalents thereof, the present disclosure is intended to include such modifications and variations

What is claimed is:

1. A circuit interconnecting device, comprising a circuit connection board and a detachable circuit board, wherein, the circuit connection board comprises an input terminal, an output terminal and an onboard slot member, the input terminal is coupled to the onboard slot member through a first circuit, and the output terminal is coupled to the onboard slot member through a second circuit; and the detachable circuit board is inserted into the onboard slot member to make the first circuit and the second circuit electrically connected, and the detachable circuit board comprises a first writing for transmitting a non-power supply signal and a second wiring for transmitting a power supply signal, a distance from an end of the second wiring to an insertion end plane of the circuit board is larger than a distance from an end of the first wiring to the insertion end plane of the circuit board.

2. The circuit interconnecting device according to claim 1, wherein the onboard slot member is disposed on a board body of the circuit connection board and has a socket.

3. The circuit interconnecting device according to claim 2, wherein the onboard slot member is perpendicular to the board body of the circuit connection board, and the socket is upward.

4. The circuit interconnecting device according to claim 3, wherein the input terminal of the circuit connection board is an input slot member and the output terminal of the circuit connection board is an output slot member.

5. The circuit interconnecting device according to claim 4, wherein a socket of the input slot member and a socket of the output slot member face away from the onboard slot member.

6. The circuit interconnecting device according to claim 1, wherein the first circuit comprises a plurality of wirings arranged in parallel, and the second circuit comprises a plurality of wirings arranged in parallel.

7. The circuit interconnecting device according to claim 1, wherein, a surface of the circuit board is provided with a plurality of first side wirings which are insulated from each other, another surface of the circuit board is provided with a plurality of second side wirings which are insulated from each other, and the plurality of second side wirings are connected to the plurality of first side wirings one by one;

a slot wall of the onboard slot member has a plurality of first connection terminals which are connected to the first circuit and connected to the plurality of first side wirings correspondingly, and a plurality of second connection terminals which are connected to the second circuit and connected to the plurality of second side wirings correspondingly.

8. The circuit interconnecting device according to claim 7, wherein the first side wiring and the second side wiring corresponding to each other are connected through a vial hole in the circuit board.

9. The circuit interconnecting device according to claim 8, wherein the first side wiring and the second side wiring corresponding to each other are connected through a printed circuit disposed on the circuit board.

10. The circuit interconnecting device according to claim 1, further comprising a jig body, an input circuit and an output circuit, wherein the circuit connection board is fixed on the jig body, the input circuit is connected to the input terminal of the circuit connection board, and the output circuit is connected to the output terminal of the circuit connection board.

11. The circuit interconnecting device according to claim 2, wherein the circuit board comprises a first wiring for transmitting a non-power supply signal and a second wiring for transmitting a power supply signal, a distance from an end of the second wiring to an insertion end plane of the circuit board is larger than a distance from an end of the first wiring to the insertion end plane of the circuit board.

12. The circuit interconnecting device according to claim 3, wherein the circuit board comprises a first wiring for transmitting a non-power supply signal and a second wiring for transmitting a power supply signal, a distance from an end of the second wiring to an insertion end plane of the circuit board is larger than a distance from an end of the first wiring to the insertion end plane of the circuit board.

13. The circuit interconnecting device according to claim 2, wherein the first circuit comprises a plurality of wirings arranged in parallel, and the second circuit comprises a plurality of wirings arranged in parallel.

14. The circuit interconnecting device according to claim 3, wherein the first circuit comprises a plurality of wirings arranged in parallel, and the second circuit comprises a plurality of wirings arranged in parallel.

15. The circuit interconnecting device according to claim 2, wherein, a surface of the circuit board is provided with a plurality of first side wirings which are insulated from each other, another surface of the circuit board is provided with a plurality of second side wirings which are insulated from each other, and the plurality of second side wirings are connected to the plurality of first side wirings one by one;

a slot wall of the onboard slot member has a plurality of first connection terminals which are connected to the first circuit and connected to the plurality of first side wirings correspondingly, and a plurality of second connection terminals which are connected to the second circuit and connected to the plurality of second side wirings correspondingly.

16. The circuit interconnecting device according to claim 3, wherein, a surface of the circuit board is provided with a plurality of first side wirings which are insulated from each other, another surface of the circuit board is provided with a plurality of second side wirings which are insulated from each other, and the plurality of second side wirings are connected to the plurality of first side wirings one by one;

a slot wall of the onboard slot member has a plurality of first connection terminals which are connected to the first circuit and connected to the plurality of first side wirings correspondingly, and a plurality of second connection terminals which are connected to the second circuit and connected to the plurality of second side wirings correspondingly.

17. The circuit interconnecting device according to claim 2, further comprising a jig body, an input circuit and an output circuit, wherein the circuit connection board is fixed on the jig body, the input circuit is connected to the input terminal of the circuit connection board, and the output circuit is connected to the output terminal of the circuit connection board.

18. The circuit interconnecting device according to claim 3, further comprising a jig body, an input circuit and an output circuit, wherein the circuit connection board is fixed on the jig body, the input circuit is connected to the input terminal of the circuit connection board, and the output circuit is connected to the output terminal of the circuit connection board.

19. The circuit interconnecting device according to claim 4, further comprising a jig body, an input circuit and an output circuit, wherein the circuit connection board is fixed on the jig body, the input circuit is connected to the input terminal of the circuit connection board, and the output circuit is connected to the output terminal of the circuit connection board.

* * * * *